US007437983B2

(12) United States Patent
Burke et al.

(10) Patent No.: US 7,437,983 B2
(45) Date of Patent: Oct. 21, 2008

(54) BOOK SKEW CLAMPING DEVICE

(75) Inventors: Timothy Andrew Burke, Halifax (CA); John Brian Duquette, Henniker, NH (US)

(73) Assignee: Goss International Americas, Inc., Durham, NH (US)

( * ) Notice: Subject to any disclaimer, the term of this patent is extended or adjusted under 35 U.S.C. 154(b) by 810 days.

(21) Appl. No.: 10/946,807

(22) Filed: Sep. 22, 2004

(65) Prior Publication Data

US 2005/0034579 A1 Feb. 17, 2005

Related U.S. Application Data

(62) Division of application No. 10/271,707, filed on Oct. 15, 2002, now Pat. No. 6,810,778.

(51) Int. Cl.
*B26D 7/08* (2006.01)

(52) U.S. Cl. ..... 83/454; 83/175; 83/176; 83/206; 83/934; 83/636

(58) Field of Classification Search ..... 83/14, 83/18, 175, 176, 454, 933, 904, 277, 934, 83/91, 93, 206, 49, 636, 85, 86, 88, 456; 412/1, 16, 26, 32; 270/52.09, 52.08, 52.17
See application file for complete search history.

(56) References Cited

U.S. PATENT DOCUMENTS

| | | | | | |
|---|---|---|---|---|---|
| 3,422 | A | * | 2/1844 | Riehl | 68/91 |
| 350,318 | A | * | 10/1886 | Phelan | 269/164 |
| 1,764,828 | A | * | 6/1930 | Cotton | 101/42 |
| 2,329,890 | A | * | 9/1943 | Fisher | 83/418 |
| 3,074,304 | A | * | 1/1963 | Coie | 83/456 |
| 3,167,987 | A | * | 2/1965 | McCain | 83/268 |
| 4,132,138 | A | * | 1/1979 | Miyamoto | 83/697 |
| 5,086,681 | A | * | 2/1992 | Ruetschle et al. | 83/277 |
| 5,197,364 | A | * | 3/1993 | Heutschi | 83/29 |
| 6,030,163 | A | * | 2/2000 | Flannery, Jr. | 412/8 |
| 2002/0034428 | A1 | * | 3/2002 | Marsh | 412/16 |
| 2004/0020340 | A1 | * | 2/2004 | Burke et al. | 83/613 |

FOREIGN PATENT DOCUMENTS

EP 1153872 11/2001

* cited by examiner

*Primary Examiner*—Boyer D. Ashley
(74) *Attorney, Agent, or Firm*—Davidson, Davidson & Kappel, LLC

(57) ABSTRACT

A trimmer producing a profiled spine in a book. The device includes a first clamp element and a second clamp element contacting the second side and an actuating device moving the first clamp element with respect to the second clamp element so as to skew the spine. A trimming blade cuts the book.

6 Claims, 7 Drawing Sheets

BOOK SKEW CLAMPING DEVICE

CROSS-REFERENCE TO RELATED APPLICATIONS

This is a divisional of U.S. patent Ser. No. 10/271,707 filed Oct. 15, 2002, now U.S. Pat. No. 6,810,778, and hereby incorporated by reference herein.

BACKGROUND OF THE INVENTION

The present invention relates generally to printed materials and more particularly to clamping devices and trimming units for trimming edges of a book.

U.S. Pat. No. 6,030,163 discloses a method for fusing two or more pieces along an edge to produce a volume. The volume can have a skewed spine.

U.S. Pat. No. 5,086,681 discloses transferring books using an infeed conveyor system having a belt. The belt travels at slower speed than conveyor chains to create a slight frictional force on pusher members attached to the conveyor chains. As the books leave the infeed conveyor system, they are impelled into a first trimming station.

BRIEF SUMMARY OF THE INVENTION

A problem associated with prior art trimmers used for trimming books is the delamination of the cover of a book from the interior sheet material. This trim defect is typically called "chipout".

FIGS. 1 and 2 show a force vector analysis by the present inventors, in which the forces of a straight trim blade at an angle alpha are analyzed as a trimming blade 10 with a straight edge 12 cuts an end of a book 20. Book 20 includes sheet material 26 and a cover 22, connected to sheet material 26 by adhesive 24.

A resultant force FR normal to the blade edge 12 results, with a force component F1 parallel to a tangent line of the cover interaction with the sheet material 26, and a component FN normal to the tangent line. As shown in FIG. 1, as the blade 12 first cuts at the top of the book 26 and cover 22, the normal force FN is directed into the book. At this stage, generally no chipout occurs.

However, as shown in FIG. 2, as the cut progresses through the lower curved section 28 of cover 22, the normal force FN acting on cover 22 is directed away from sheet material 26, and can cause chipout, since the force is directed away from the sheet material 26.

One object of the present invention is to provide a method for producing a skewed spine in a book. Anther alternate or additional object of the present invention is to improve cutting of books, especially of the sides of books adjacent to the spine. Another alternate or additional object of the present invention is to reduce chipout in reciprocating blade trimmers.

European Patent Application No. 1 153 872, which corresponds to commonly-assigned U.S. patent application Ser. No. 09/570,203 filed May 12, 2000, discloses creating a skew in a collated sheet product.

The present invention provides a method for producing a profiled spine in a book having a first side defining a first plane, a second side defining a second plane and a spine, the method comprising the steps of:

clamping the book using a first clamp element contacting the first side and the second clamp element contacting the second side; and moving the first element with respect to the second element so as to skew the spine by moving at least one of the first side in the first plane and the second side in the second plane.

The present method advantageously permits creation of a skewed spine, which can be advantageous in reducing chip out in trimming devices, for example.

Preferably, the method further includes trimming the skewed spine. The skewed spine may form a skew angle with respect to the first plane, the skew angle preferably being an acute angle. The trimming may proceed from the first side to the second side. The acute skew angle reduces the chipout effect of the trimming.

The present invention also provides a clamp having a first clamping element, a second clamping element for clamping a bound book, and an actuating device moving the first clamping element with respect to the second clamping element to create a shearing force in the book.

The present invention also provides a trimmer having a blade and a clamp according to the present invention.

Figure 1:
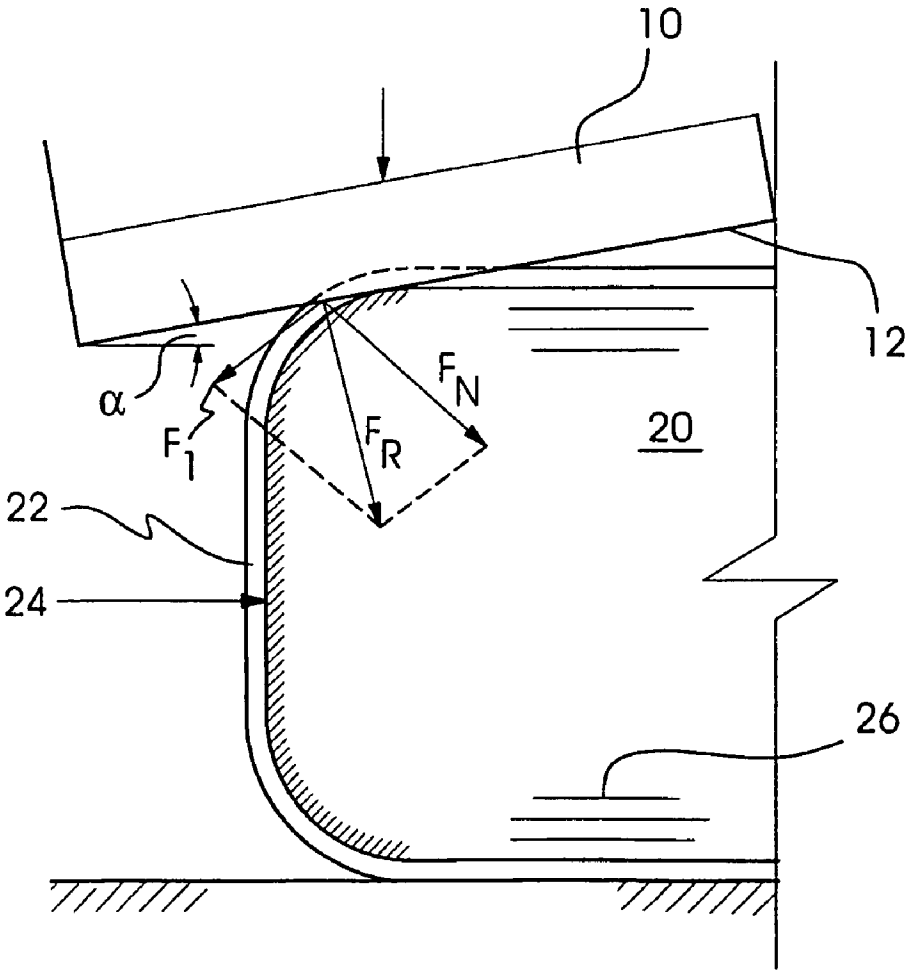
Fig. 1 PRIOR ART
FIG. 1 shows a force analysis of a prior art blade edge cutting through a top section of a vertical book spine.
Figure 2:
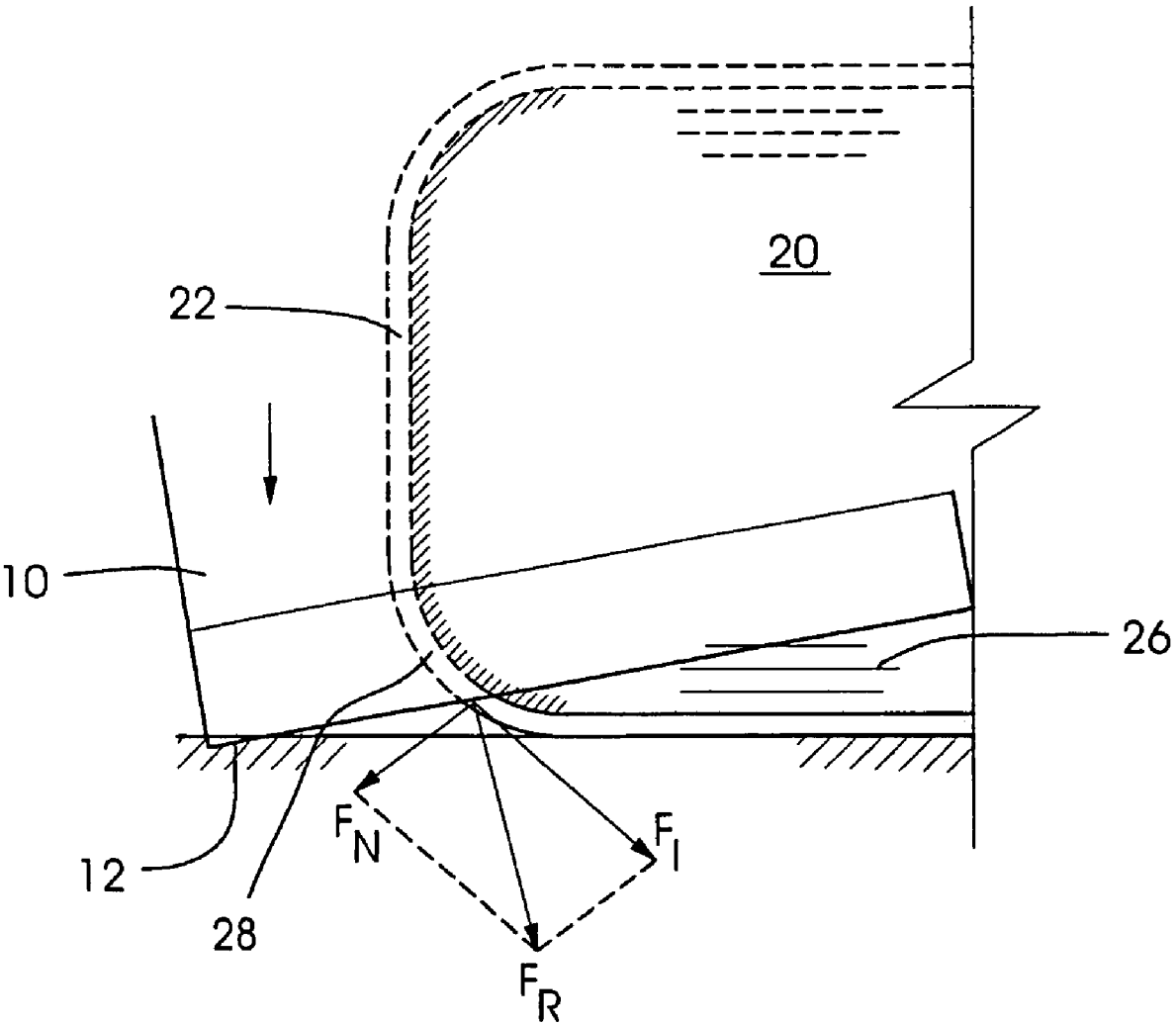
Fig.2 PRIOR ART
FIG. 2 shows a force analysis of a prior art blade edge cutting through the bottom of the vertical book spine of FIG. 1.
Figure 3:
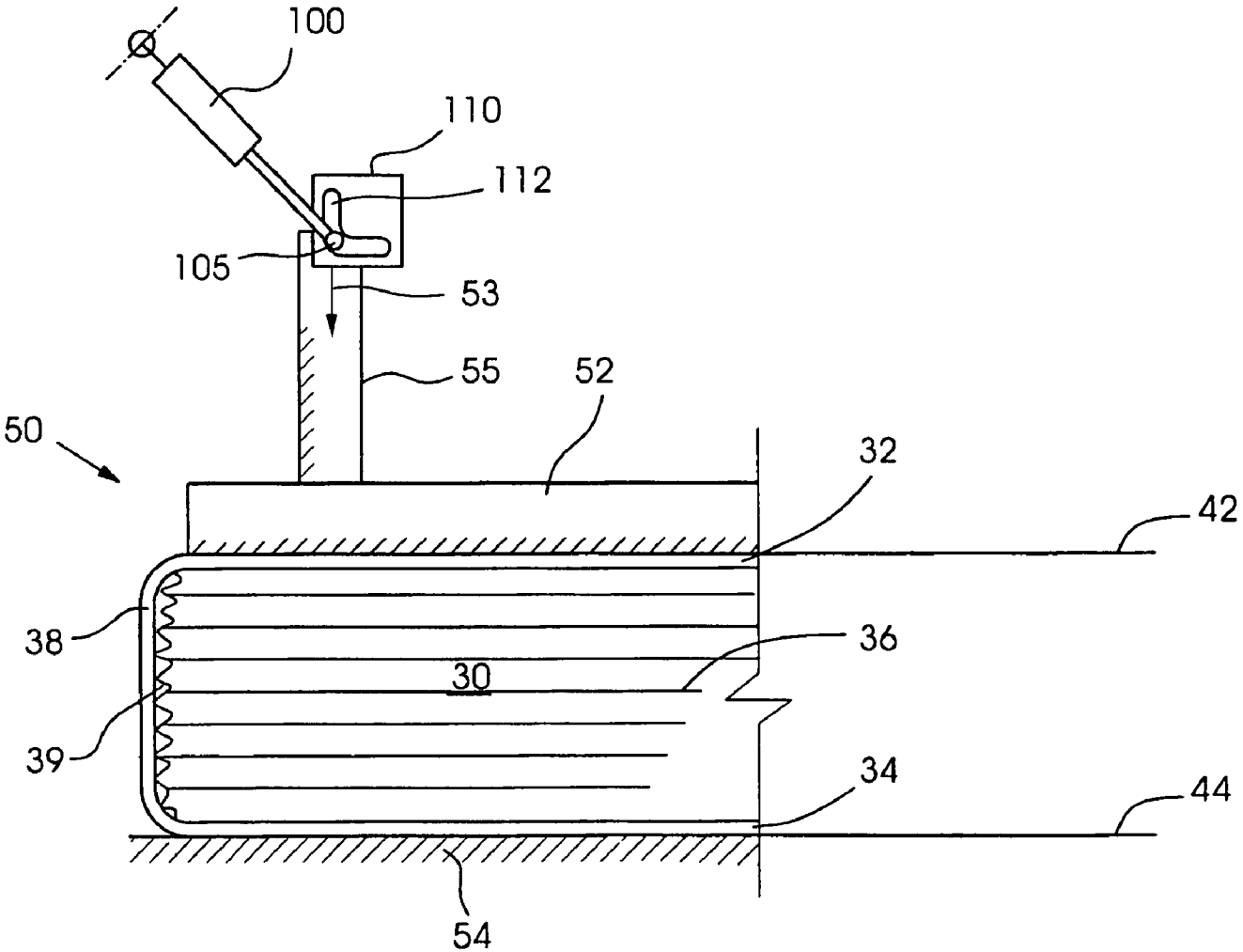
Figure 4:
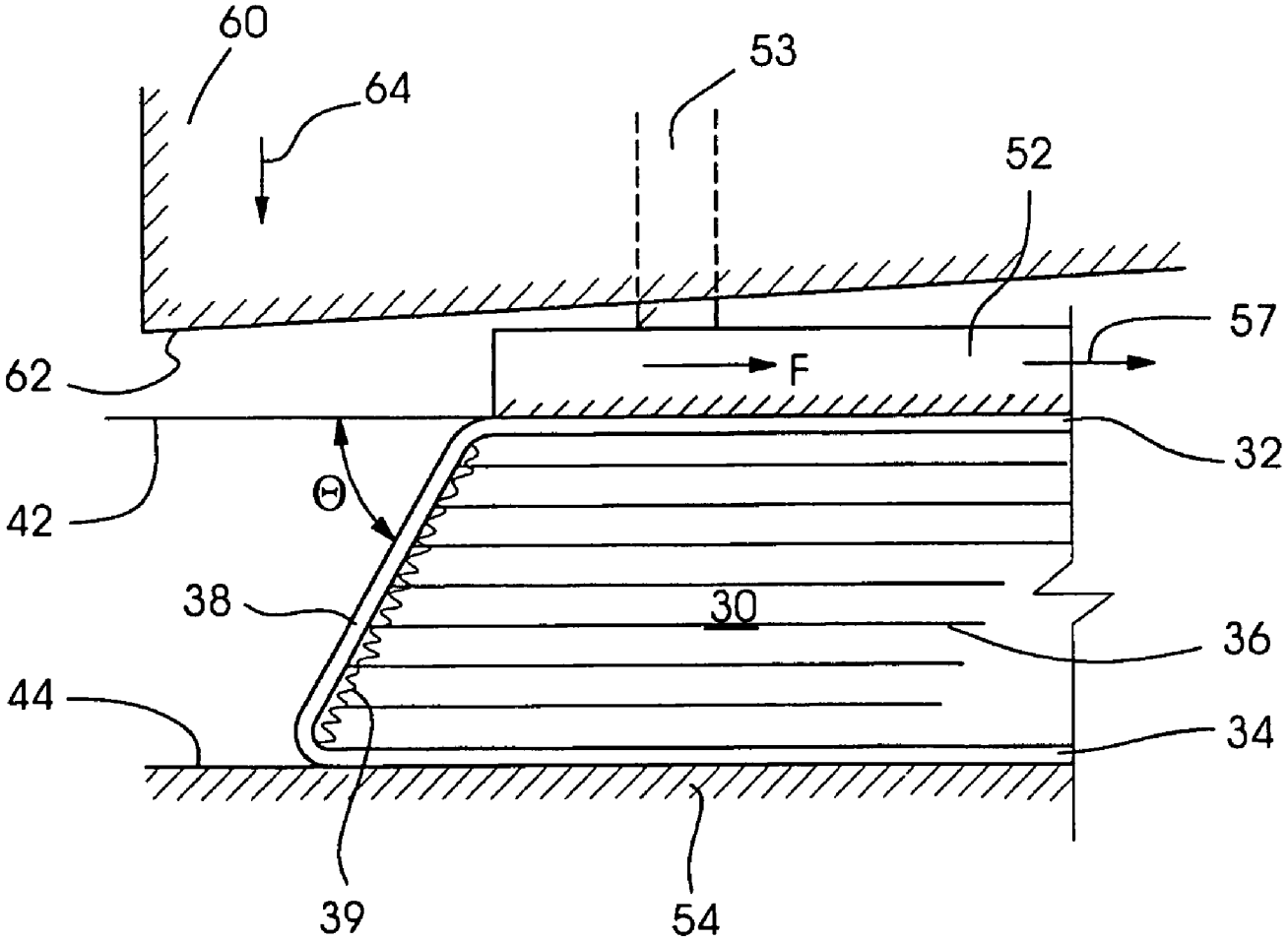
Figure 5:
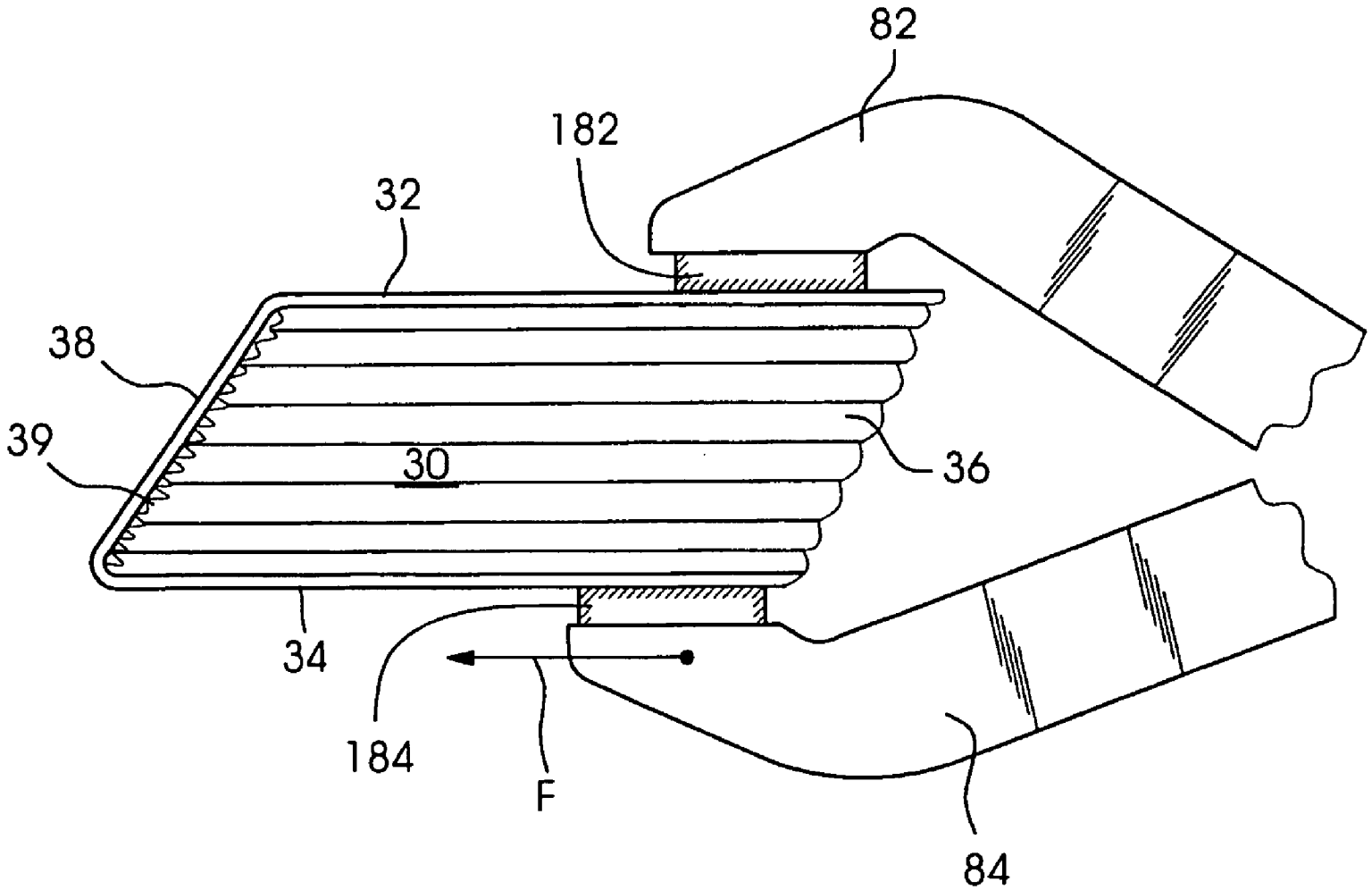
Figure 6:
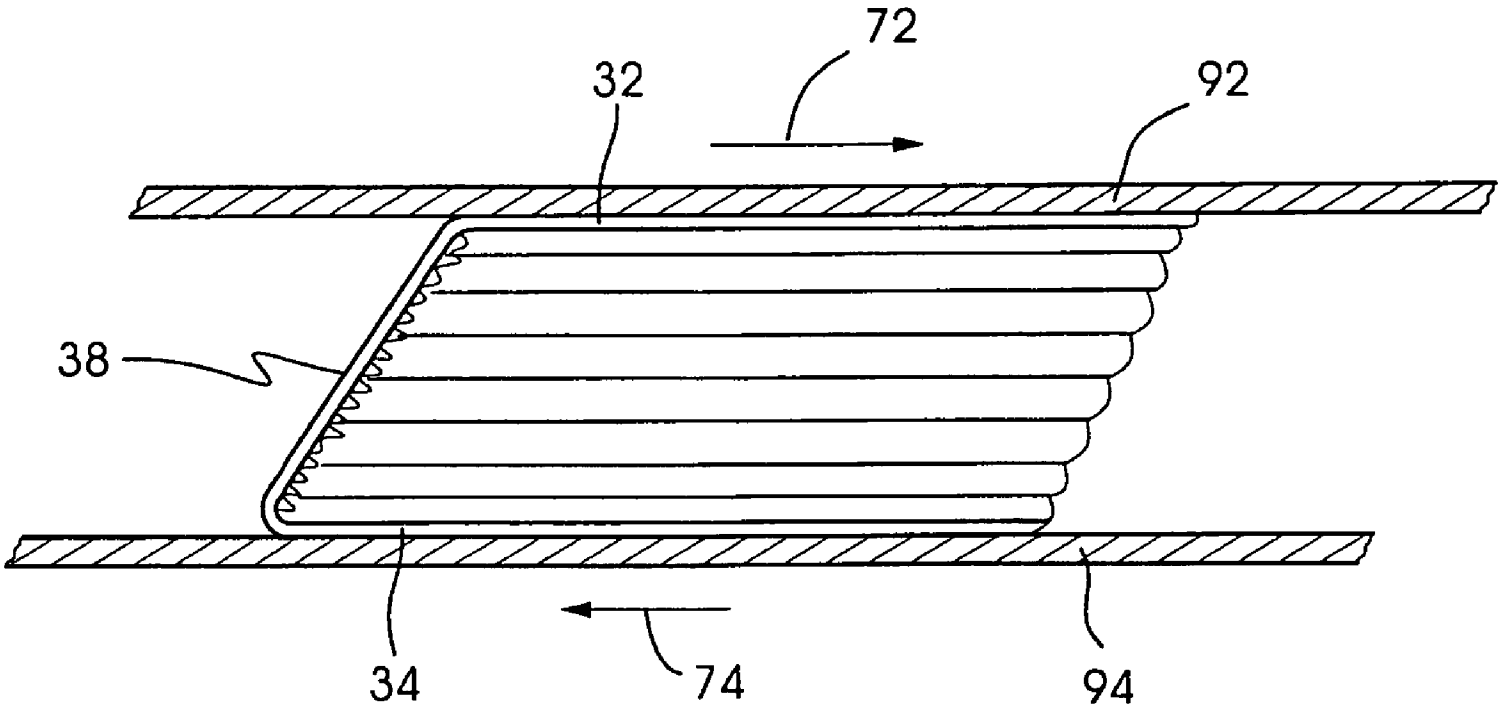
Figure 7:
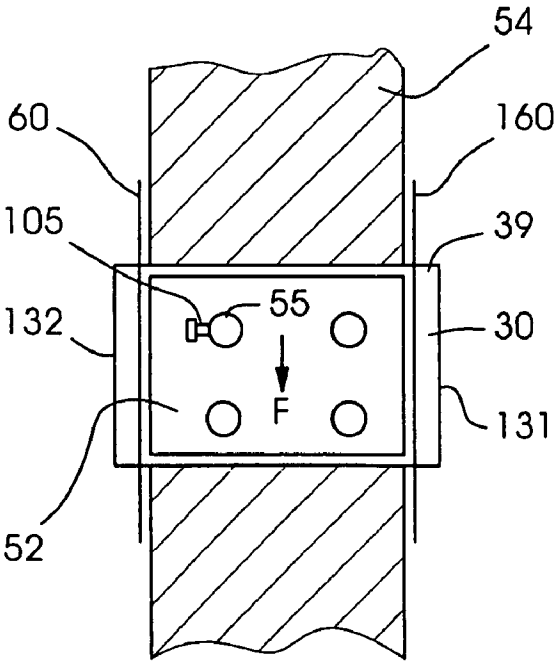

Three preferred embodiments of the clamping device of the present invention are described below by reference to the following drawings, in which:

FIG. 3 shows one embodiment of a trimmer having a first embodiment of a clamping device according to the present invention;

FIG. 4 shows a the FIG. 3 embodiment with the trimmer blade descending;

FIG. 5 shows a second embodiment of a clamping device according the present invention;

FIG. 6 shows a third embodiment of a clamping device according to the present invention;

FIG. 7 shows a schematic top view of the embodiment of FIG. 3; and

Figure 8:
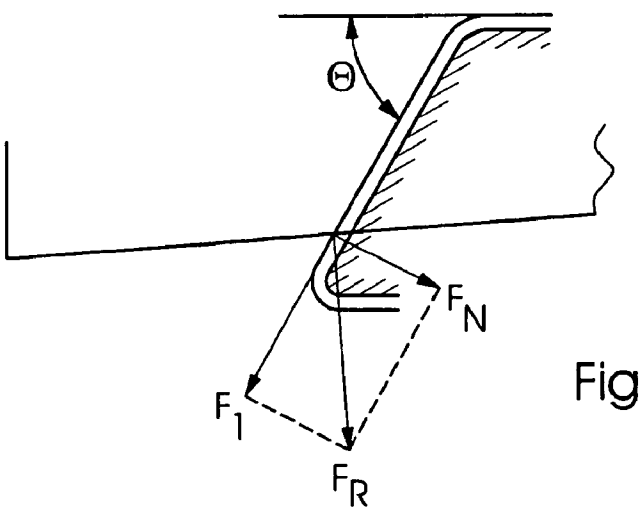

FIG. 8 shows a force vector analysis on the skewed spine.

DETAILED DESCRIPTION OF THE PREFERRED EMBODIMENTS

FIG. 3 shows a first embodiment of an edge trimmer having a clamping device 50 with a first clamp element 52 and a second clamp element 54, which in this embodiment may be a horizontal stationary or moving support. An untrimmed book 30 has a first side 32 defining a first plane 42 and a second side 34 defining a second plane 44. The sides 32, 34 may be formed by a cover for sheet material 36, the cover having a spine 38 with an adhesive 39 binding the sheet material 36.

Side 34 rests horizontally on clamp element 54, which is advantageous as the book 30 is then in a stable position. Clamp element 52 may then clamp first side 32 by moving in direction 53.

For example, clamp element 52 may be fixed to a rod 55 having a cam follower 105 extending from the side of the rod 55. A piston 100 pivotally attached to the cam follower 105 and at its other end pivotally to a fixed support may drive cam follower 105 to follow a cam 112 in a cam support 110. As the piston extends cam follower 105 is driven down the cam 112 in direction 53 so that clamp element 52 clamps book 30.

As shown in FIG. 4, clamp element 52 may then move in direction 57 as the cam follower 105 reaches a horizontal portion of the cam 112, so that a shear force F is imparted on first side 32, which moves along plane 42. Second side 34 remains fixed on stationary clamp element 54, so that an acute angle theta is created between spine 38 and first plane 42.

Actuating mechanisms other than the single piston/cam device shown in FIG. 3 are possible, for example a two piston device.

A reciprocating side trimming blade 60 with a blade edge 62 may move in direction 64 to trim the sides of the book 30. As shown in FIG. 8, due to the angle theta, the normal force FN on spine 38 created by the force FR of blade 60 is increased, so that chipout may be reduced over most of the spine.

FIG. 7 shows a top view of the FIG. 3 embodiment, which shows edges 131 and 132 of book 30 extending past the clamp elements 52, 54, so that trimming blades 60, 160 may trim the edges 132, 131, respectively.

Clamping element 54 may be a moving conveyor as well, but a relative movement between elements 52, 54 is required to create the skew.

FIG. 5 shows a second embodiment of the clamping device of the present invention having a first clamp element 82 with a clamp pad 182 and a second clamp element 84 with a clamp pad 184. The clamp elements 82, 84 may be arms that clamp the book in a first motion and then slide with respect to each other to create a differential movement which creates shear force F.

FIG. 6 shows a further embodiment of the present invention in which the clamping device of the present invention includes a first clamp element 92 moving in direction 72 and a second clamp element 94 moving in direction 74 (although direction 74 may be the same direction as direction 72, with clamp element 94 moving more slowly that clamping element 92). Clamp elements 92, 94 thus may be moving conveyor belts imparting a frictional force on sides 32, 34 respectively.

"Book" as defined herein may be any collection of sheet material with a spine. "Clamp element" as defined herein is any element providing a frictional force to the side of a book operative for moving the side of the book.

What is claimed is:

1. A book trimmer comprising:

a first clamping element having a first clamping surface;

a second clamping element having a second clamping surface, the second clamping surface being parallel and spaced with respect to the first clamping surface;

an actuating device moving the first clamping surface perpendicular with respect to the second clamping surface to clamp the book and moving the first clamping surface parallel with respect to the second clamping surface; and a trimming blade for cutting the book.

2. The trimmer as recited in claim 1 further comprising a second trimming blade for trimming another part of the book.

3. The trimmer as recited in claim 1 wherein the second clamping element is stationary.

4. The trimmer as recited in claim 1 wherein the trimming blade is reciprocating.

5. The trimmer as recited in claim 1 wherein the trimming blade is angled with respect to the book.

6. The trimmer as recited in claim 1 wherein the actuating device is a conveyor.

* * * * *